US007735397B2

(12) United States Patent
Junkers

(10) Patent No.: US 7,735,397 B2
(45) Date of Patent: Jun. 15, 2010

(54) FLUID OPERATED TORQUE TOOL FOR AND A METHOD OF TIGHTENING A NUT ON A PLATE ON RAILROAD CROSSINGS

(76) Inventor: John K. Junkers, 14 Algonquin Trail, Saddle River, NJ (US) 07458

( * ) Notice: Subject to any disclaimer, the term of this patent is extended or adjusted under 35 U.S.C. 154(b) by 172 days.

(21) Appl. No.: 11/756,705

(22) Filed: Jun. 1, 2007

(65) Prior Publication Data

US 2009/0223326 A1 Sep. 10, 2009

(51) Int. Cl.
*B25B 13/48* (2006.01)

(52) U.S. Cl. ..... 81/55

(58) Field of Classification Search ..... 81/55, 81/56, 57.3, 57.31, 57.4, 57.44; 29/428, 29/525.01

See application file for complete search history.

(56) References Cited

U.S. PATENT DOCUMENTS

| | | | | | |
|---|---|---|---|---|---|
| 1,033,182 | A * | 7/1912 | Luthman | ..... | 81/55 |
| 1,136,755 | A * | 4/1915 | Baker | ..... | 81/55 |
| 1,389,468 | A * | 8/1921 | White | ..... | 81/55 |
| 2,682,188 | A * | 6/1954 | Ferrell | ..... | 81/54 |
| 2,898,792 | A * | 8/1959 | Fox et al. | ..... | 81/57.41 |
| 3,604,292 | A * | 9/1971 | Sada | ..... | 81/57.11 |
| 4,179,955 | A | 12/1979 | Akiyoshi et al. | | |
| 5,140,874 | A * | 8/1992 | Junkers | ..... | 81/57.39 |
| 5,226,327 | A | 7/1993 | Fassina | | |
| 5,513,546 | A * | 5/1996 | Ikeda et al. | ..... | 81/57.13 |
| 5,533,426 | A | 7/1996 | Morales | | |
| 6,253,642 | B1 * | 7/2001 | Junkers | ..... | 81/55 |
| 6,490,952 | B2 * | 12/2002 | Junkers | ..... | 81/57.39 |
| 2001/0039858 | A1 | 11/2001 | Junkers | | |
| 2007/0095173 | A1 | 5/2007 | Jensen et al. | | |

FOREIGN PATENT DOCUMENTS

| | | |
|---|---|---|
| DE | 1 902 263 | 11/1969 |
| EP | 1 435 279 | 7/2004 |
| EP | 1 506 842 | 2/2005 |
| GB | 2 437 656 | 10/2007 |
| JP | 8-052663 | 2/1996 |
| PL | 140 037 | 11/1987 |
| PL | 168670 | 3/1996 |
| PL | 188564 | 7/1999 |

* cited by examiner

*Primary Examiner*—David B Thomas
(74) *Attorney, Agent, or Firm*—Michael J. Striker

(57) ABSTRACT

A fluid operated torque tool tightens a nut through a spring washer on a plate on a railroad crossing, and has a housing, two coaxial drives applying equal turning forces in opposite directions around an axis, with one of the two coaxial drives located around the other of the two coaxial drives, a first socket attached to the one coaxial drive and configured to fit on the rectangular plate, and a second socket attached to the other coaxial drive inside the first socket and configured to fit on the nut, with the washer being not engaged by the sockets, so as to tighten the nut and to tighten up the spring washer onto the plate while the first socket and the housing stand still.

1 Claim, 1 Drawing Sheet

FLUID OPERATED TORQUE TOOL FOR AND A METHOD OF TIGHTENING A NUT ON A PLATE ON RAILROAD CROSSINGS

BACKGROUND OF THE INVENTION

The present invention relates to a fluid operated torque tool for, and a method of tightening a nut onto a plate with a washer there between.

More particularly, the present invention relates to a fluid operated torque tool for, and a method of tightening a nut onto a plate with a washer there between, to be used in particular in railroad frog crossing applications.

Frog railroad crossings generally refer to the crossing point of two rails. A railroad frog typically forms part of a railroad switch, and is also used in a level junction, also referred to as a flat crossing.

Such frog railroad crossings have historically presented problems because of the substantial weight and vibration applied to such frog crossings when trains pass over such rails. The substantial weight and vibration caused by the passing over frog crossings by locomotives and railroad cars can have the effect of loosening the rail fasteners, thereby causing a dangerous condition.

Fluid operated torque tools are typically used to fasten frog crossing rails to underlying plates, which in turn are affixed to railroad ties. However, when tightening the nut to fasten the rail against the plate with a fluid operated torque tool, the torque applied is subject to reaction, and the usual reaction fixtures of such torque tools apply a very substantial amount of side load onto the nut to be tightened. The result is a change in the turning friction of the nut that changes and thereby reduces the torque of the tool. This causes frequent nut loosening and even disassembly of the rail crossing, which in turn can have the dangerous result of a locomotive or rail car running off the track.

An additional problem is that the side load runs through the tool mechanism, thereby making the torque tool subject to early failure.

In order to avoid the problems presented above, it is desirable to achieve a known torque within 3% accuracy, which requires a coaxial action and reaction. Torque tools having a coaxial action and reaction exist, but have the distinct disadvantage of having the reaction socket abut against the nut to be tightened.

SUMMARY OF THE INVENTION

Accordingly, it is an object of the present invention to provide a fluid operated torque tool for and a method of tightening a nut on a plate with a washer therebetween on railroad crossings, which avoid the disadvantages of the prior art.

In keeping with these objects and with others which will become apparent hereinafter, one feature of the present invention resides, briefly stated, in a fluid operated torque tool for tightening a nut on a plate with a washer therebetween on railroad crossings, comprising a housing; two coaxial drive means applying equal turning forces in opposite directions around an axis, one of said two coaxial drive means being located around the other said two coaxial drive means; a first socket attached to one of said coaxial drive means and configured to fit on the plate; and a second socket attached to the other of said coaxial drive means, located inside said first socket and configured to fit on the nut, with the washer not engaged by the first socket and the second socket, so as to tighten the nut and to tighten up the washer onto the plate while said first socket and said housing stand still.

Another feature of the present invention resides, briefly stated, in a method for tightening a nut on a plate on railroad crossings, comprising the steps of providing a housing; applying equal turning forces in opposite directions around an axis by two coaxial drive means with one of said two coaxial drive means being located around the other said two coaxial drive means; attaching a first socket to one of said coaxial drive means to fit on the rectangular plate; attaching a second socket to fit on the nut, while leaving the washer not engaged by the first socket and the second socket, so as to tighten the nut and to tighten up the spring washer onto the plate while said first socket and said housing stand still.

When the fluid operated torque tool is designed and the method is performed in accordance with the present invention, reliable tightening of a nut and a tightening up of a spring washer onto a rectangular plate, for example in frog railroad crossings is achieved.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawing is a view schematically showing a fluid-operated tool for tightening a nut on a plate with interposition of a washer, in accordance with the present invention.

DESCRIPTION OF THE PREFERRED EMBODIMENTS

Figure 1:
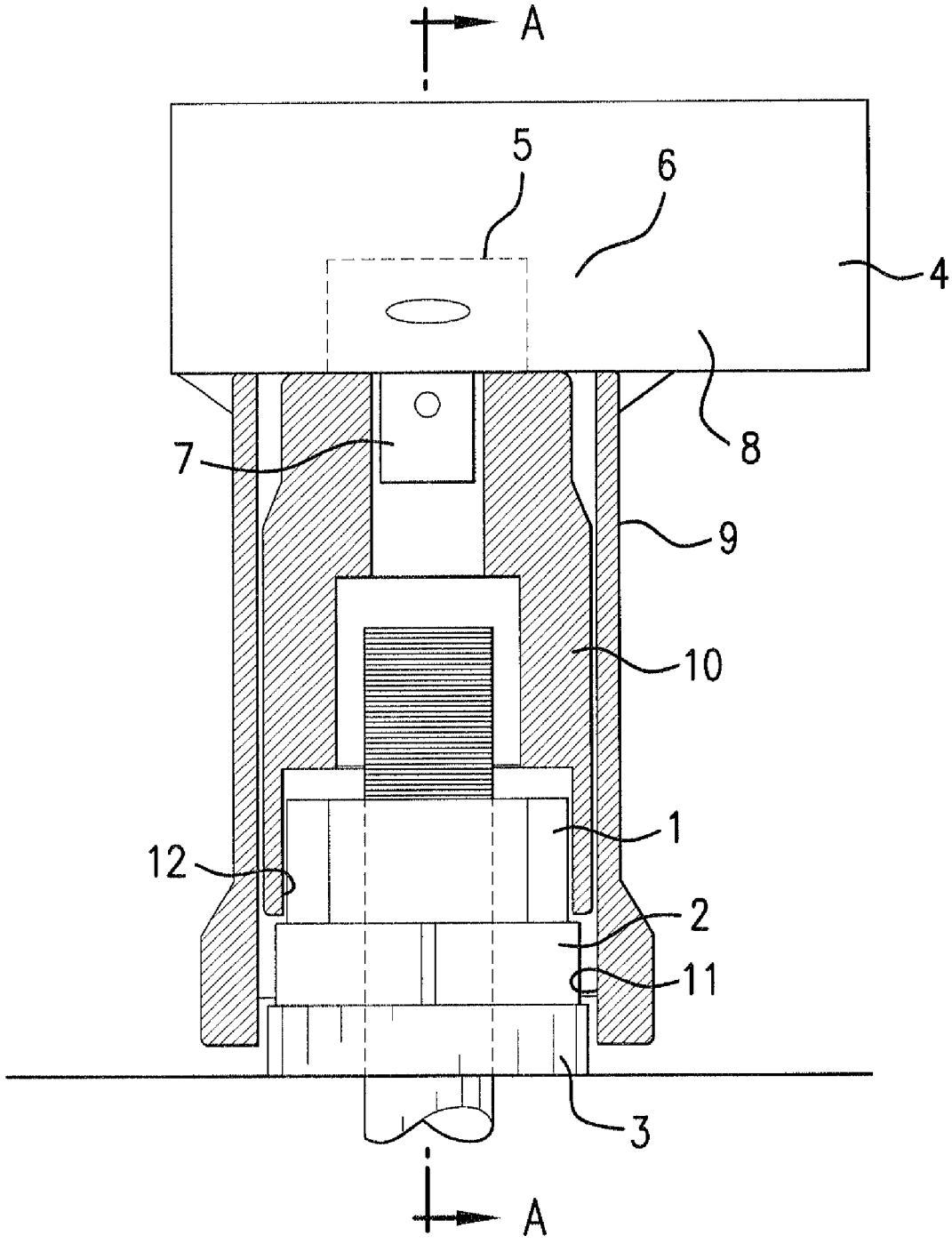

A fluid operated tool and a method of tightening in accordance with the present invention are used for tightening a nut arranged on a stud, bolt, and the like, for example a square nut 1, to tighten up a washer, for example a spring washer 2, onto a plate, for example a rectangular plate 3, used for example in frog railroad crossings.

A fluid operated torque tool has a housing which is identified with reference numeral 4. Two coaxial drive means are provided to apply equal turning forces in opposite directions as identified with reference numerals 5 and 6. The drive means 5 include a schematically shown drive located in the housing 4, with a turning element 7 extending outwardly beyond the housing, while the drive means 6 is formed as an immovable part 8 of the housing 1.

The drive means 5 and 6 are coaxial with one another with respect to an axis A, and the drive means 6 is located around the drive means 5.

A first socket 9 is attached to the drive means 6, or in particular to the immovable part 8 of the housing 4. A second socket 10 is attached to the drive means 5, or in particular to the turning element 7 of the tool. The second socket 10 is located inside the first socket 9.

The first socket 9 is configured so that it fits on the rectangular plate 3. In particular, it can have an inner polygonal (for example rectangular) surface 11 which engages an outer peripheral surface of the rectangular plate 3.

The second socket 10 fits onto the rectangular nut 2. In particular, it can have an inner polygonal (for example square) surface 12 which engages an outer peripheral surface of the square nut 2.

The washer 2 which is located between the nut 1 and the plate 3 is not engaged either by the socket 9 or by the socket 10.

When the fluid operated torque tool is activated and the driving element 7 is turned, the second socket 10 which peripherally engages the square nut 1 turns the nut 1 so as to tighten it and to tighten up the spring washer 2 onto the rectangular plate 3, while the first socket 9 and the housing 1 stand still.

It will be understood that each of the elements described above, or two or more together, may also find a useful application in other types of constructions differing from the types described above.

While the invention has been illustrated and described as embodied in a fluid operated torque tool for and a method of tightening a nut on a plate, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for tightening a nut on a plate of a railroad crossing, comprising the steps of arranging a washer between the nut and the plate; engaging the plate with an inner surface of a first socket so that the first socket passes over the washer without engaging the washer; engaging the nut with an inner surface of a second socket so that the second socket extends inside the first socket coaxially with the latter without engaging the washer; applying a force by one drive to the first socket engaging the plate so that the first socket stands still and holds the washer; applying a force in an opposite direction by another drive to the second socket engaging the nut so that the second socket is turned and turns the nut, so as to tighten up the nut through the spring washer onto the plate, without engaging the washer by the first and second sockets.

* * * * *